US009066581B2

(12) United States Patent
Hohlbein et al.

(10) Patent No.: US 9,066,581 B2
(45) **Date of Patent: *Jun. 30, 2015**

(54) ORAL CARE IMPLEMENT

(71) Applicant: COLGATE-PALMOLIVE COMPANY, New York, NY (US)

(72) Inventors: Douglas J. Hohlbein, Hopewell, NJ (US); Chi Shing Wong, Warren, NJ (US); Wen Jin Xi, Shanghai (CN); James Herbert Kemp, Basking Ridge, NJ (US); Al Aquanza Sprosta, Maplewood, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 10 days.

This patent is subject to a terminal disclaimer.

(21) Appl. No.: 14/027,608

(22) Filed: Sep. 16, 2013

(65) Prior Publication Data

US 2014/0007907 A1 Jan. 9, 2014

Related U.S. Application Data

(63) Continuation of application No. 13/660,360, filed on Oct. 25, 2012, now Pat. No. 8,556,530, which is a continuation of application No. 11/673,758, filed on Feb. 12, 2007, now Pat. No. 8,322,939, which is a continuation of application No. PCT/US2005/028400, filed on Aug. 10, 2005, which is a continuation-in-part of application No. 10/986,809, filed on Nov. 15, 2004, now Pat. No. 7,273,327, which is a continuation-in-part of application No. 10/869,922, filed on Jun. 18, 2004, now Pat. No. 7,143,462, which is a continuation-in-part of application No. 10/601,106, filed on Jun. 20, 2003, now abandoned.

(60) Provisional application No. 60/600,701, filed on Aug. 11, 2004.

(51) Int. Cl.

| | |
|---|---|
| ***A46B 11/00*** | (2006.01) |
| ***A46B 15/00*** | (2006.01) |
| ***A46B 5/00*** | (2006.01) |
| ***A46B 9/04*** | (2006.01) |

(52) U.S. Cl.

CPC ..... *A46B 15/0016* (2013.01); *A46B 5/00* (2013.01); *A46B 11/00* (2013.01); *A46B 15/0087* (2013.01); *A46B 2200/1066* (2013.01); *A46B 9/04* (2013.01); *A46B 11/0068* (2013.01)

(58) Field of Classification Search

USPC ..... 401/270, 195, 183, 194

See application file for complete search history.

(56) References Cited

U.S. PATENT DOCUMENTS

| | | | |
|---|---|---|---|
| 1,153,409 | A | 9/1915 | Wheeler |
| 2,075,681 | A | 8/1935 | Welker |

(Continued)

FOREIGN PATENT DOCUMENTS

| | | |
|---|---|---|
| CN | 1239408 | 12/1999 |
| CN | 2398984 | 10/2000 |

(Continued)

*Primary Examiner* — David Walczak

(74) *Attorney, Agent, or Firm* — Ryan M. Flandro

(57) ABSTRACT

An oral care implement includes a releasable sensory material that invokes a sensory response when in contact with tissues or surfaces of a mouth of a user. In one embodiment, an element is provided that is visually indicative of the sensory response. The oral care implement may also include a soft tissue cleaner provided with the sensory material.

7 Claims, 8 Drawing Sheets

(56) References Cited

U.S. PATENT DOCUMENTS

| | | | |
|---|---|---|---|
| 4,176,980 | A | 12/1979 | O'Neal et al. |
| 5,133,971 | A | 7/1992 | Copelan et al. |
| 5,213,428 | A | 5/1993 | Salman |
| 5,217,475 | A | 6/1993 | Kuber |
| 5,711,759 | A | 1/1998 | Smith et al. |
| 5,735,864 | A | 4/1998 | Heisinger, Jr. |
| 5,957,942 | A | 9/1999 | Yudelman |
| 6,119,296 | A | 9/2000 | Noe et al. |
| 6,352,545 | B1 | 3/2002 | Wagner |
| 6,371,133 | B1 | 4/2002 | Gant |
| 6,602,013 | B2 | 8/2003 | Clark |
| 6,769,828 | B2 | 8/2004 | Clark |
| 2003/0163149 | A1 | 8/2003 | Heisinger |
| 2003/0230319 | A1 | 12/2003 | Marcon et al. |
| 2004/0152031 | A1 | 8/2004 | Takahashi |

FOREIGN PATENT DOCUMENTS

| | | |
|---|---|---|
| CN | 2527147 | 12/2002 |
| CN | 1491608 | 4/2004 |
| DE | 20117672 | 3/2002 |
| GB | 490841 | 8/1938 |
| GB | 2391462 | 12/2004 |
| KR | 200165049 | 10/1999 |
| KR | 200272612 | 4/2002 |
| KR | 100684339 | 2/2007 |
| WO | WO 01/26564 | 4/2001 |
| WO | WO 01/34042 | 5/2001 |
| WO | WO 01/45573 | 6/2001 |
| WO | WO 01/64072 | 9/2001 |
| WO | WO 01/67928 | 12/2001 |
| WO | WO 02/15736 | 2/2002 |
| WO | WO02/26078 | 4/2002 |
| WO | WO 2004/021914 | 3/2004 |
| WO | WO 2006/065496 | 6/2006 |

ORAL CARE IMPLEMENT

CROSS-REFERENCE TO RELATED APPLICATIONS

This application is a continuation of U.S. patent application Ser. No. 13/660,360, filed Oct. 25, 2012 (now U.S. Pat. No. 8,556,530), which is a continuation of U.S. patent application Ser. No. 11/673,758, filed Feb. 12, 2007 (now U.S. Pat. No. 8,322,939), which in turn is a continuation of International Patent Application No. PCT/US2005/28400 filed, Aug. 10, 2005, which is a continuation in-part of U.S. patent application Ser. No. 10/986,809, filed Nov. 15, 2004 (now U.S. Pat. No. 7,273,327), which is a continuation in-part of U.S. patent application Ser. No. 10/869,922, filed Jun. 18, 2004 (now U.S. Pat. No. 7,143,462), which is a continuation in-part of U.S. patent application Ser. No. 10/601,106, filed Jun. 20, 2003 (now abandoned); and claims the benefit of U.S. Provisional Application No. 60/600,701, filed Aug. 11, 2004. The contents of the above-noted applications are each expressly incorporated herein by reference.

FIELD OF THE INVENTION

The present invention pertains to an oral care implement generally, and more particularly to a toothbrush that releases a chemical into the mouth during use.

BACKGROUND OF THE INVENTION

A toothbrush is used to clean the teeth by removing plaque and debris from the tooth surfaces. According to the American Dental Association, a major source of bad breath in healthy people is microbial deposits on the tongue, where a bacterial coating harbors organisms and debris that contribute to bad breath. Tissue in the mouth, and especially the tongue, is a haven for the growth of microorganisms. The papillary nature of the tongue surface creates a unique ecological site that provides an extremely large surface area, favoring the accumulation of oral bacteria. Anaerobic flora and bacteria residing on the tongue and other soft tissues in the mouth play an important role in the development of chronic bad breath commonly called halitosis. In general, the bacteria produce volatile sulfur compounds (VSC). If there is enough buildup of the sulfur compounds, the result can lead to bad breath or oral malodor.

While consumers may seek to clean their tongue or teeth, there has not been a toothbrush which provides a chemical sensory response in a mouth to enhance a user's brushing experience. Further, consumers have not been provided with a visual method to select a toothbrush which provides a sensory response. Hence, there is a need for a toothbrush that provides a biochemical sensory effect when in contact tissues of the mouth and supports a method to visually communicate the sensory effect to a user prior to use.

BRIEF SUMMARY OF THE INVENTION

The present invention pertains to an oral care implement, such as a toothbrush, including a sensory material that invokes a selective sensory response when in contact with the tissues and surfaces of a mouth of a user.

In one embodiment, a toothbrush includes a releasable material that causes a trigeminal response during use. In another embodiment, a toothbrush includes a tissue cleanser provided with the releasable material.

In another embodiment, a toothbrush includes a communicative element, such as a two-dimensional or three-dimensional shape, that is visually representative of the sensory response to the user.

In yet another embodiment, the invention can be A toothbrush comprising: a handle and a head; a releasable sensory material that invokes a sensory response in an oral cavity during use; and at least one communicative element that is visually representative of the sensory response.

In still another embodiment, the invention can be an oral care implement comprising: a handle and a head; a releasable sensory material that invokes a sensory response in an oral cavity during use; and an elastomeric element comprising a shape that is visually representative of the sensory response.

DETAILED DESCRIPTION OF THE INVENTION

Figure 1:
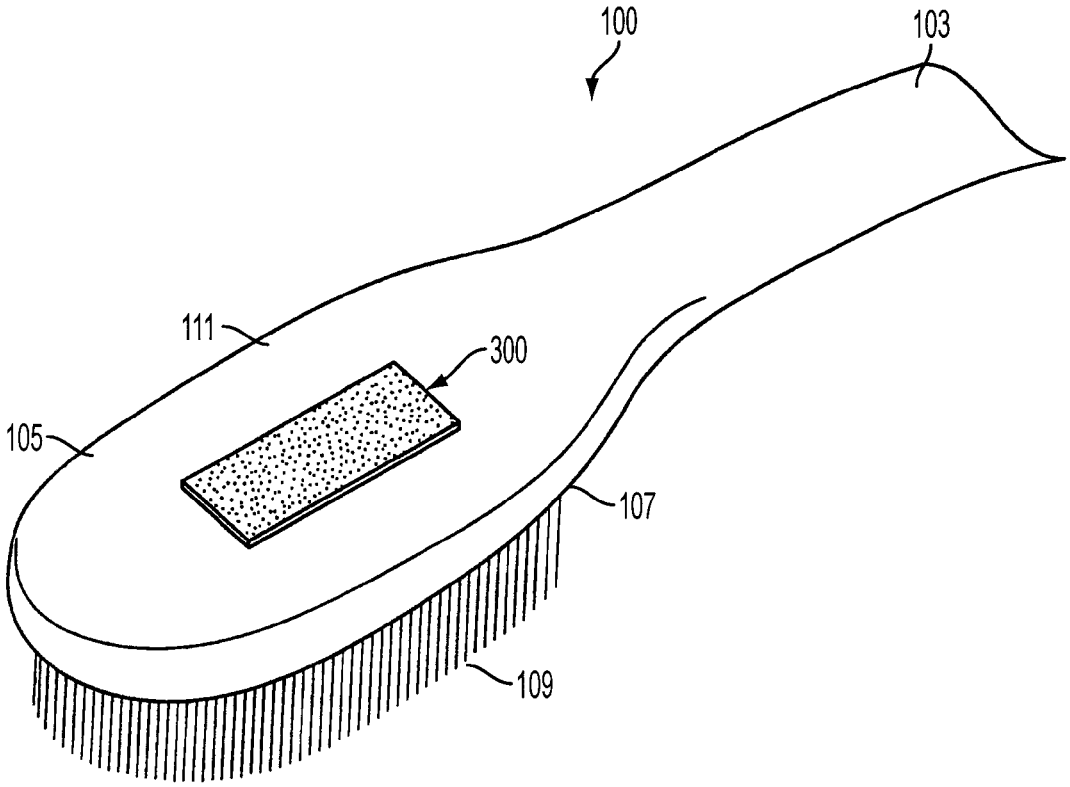
FIGS. 1-7 are each a perspective view of an oral care implement according to an alternative embodiment of the invention.

In FIG. 1, an oral care implement such as a toothbrush 100 includes a handle 103 and a head 105 for cleaning the teeth and soft tissue in the mouth. While a toothbrush 100 is shown and described as an example of an oral care implement, it will be understood that other implements usable in the oral cavity are contemplated, such as toothpicks, tongue cleaners, etc. Handle 103 enables a user to readily grip and manipulate the toothbrush, and may be formed of many different shapes and constructions including, but not limited to elastomers, polypropylene, SAN, ABS, or even paper products such as typical lollipop stick. While the head is normally widened relative to a neck of the handle, it could in some constructions simply be a continuous extension or narrowing of the handle.

Toothbrush head 105 has a first face 107 that supports tooth cleaning elements 109. An opposing second face 111 includes or supports a thin slab of a releasable material 300 on the surface or in the interior of the head 105. While the releasable material 300 is shown on the opposing second face 111, it will be understood that it may be disposed on or included in other locations of the oral care implement as desired. The tooth cleaning elements 109 can include filament bristles or elastomeric fingers or walls which are used for wiping, cleaning and/or massaging the user's teeth and gums. Other types of tooth cleaning elements known in the art may be used as desired.

The sensory material 300 can be any suitable biocompatible medication or chemical for oral use. The material 300 is released inside the mouth, lips, or cheeks by way of several methods, including but not limited to abrasion, a temperature change, a change in pH or dissolution. In one embodiment, the material is a sensate that provides a biochemical sensory response to the inside tissue and surfaces of the mouth. Such a sensory response is understood to result from stimulation of the trigeminal nerve of a human. A sensate generally produces a physiological effect without a taste, with such effect usually represented by the terms cooling, tingle, and hot (or heat).

Sensates are usually derived from single compounds that are not volatile and that do not have a smell or taste per se. As one example, a chemical known as capsaicin, found naturally in chile peppers, can be used to provide a tingle, a hot or warm massage, or a heating or warm, soothing sensation to a user. Capsaicin is also known to provide pain relief and numbing sensations when topically applied. Some examples of sensates that produce cooling sensations include (−)-menthol and camphor. Most of the polyols, including maltitol syrup, sorbitol, mannitol, erythritol, isomalt and xylitol, also provide a cooling sensation. The coolest of the polyols, erythritol, provides a distinct cooling sensation. Both erythritol and xylitol cool the mouth and fight the sensation of dry mouth commonly associated with prescription drugs and dental hygiene products. Erythritol is a naturally occurring four-carbon structure. Xylitol is a five-carbon sugar found in fruits and vegetables and made in small amounts by the human system as a metabolic intermediate.

In another embodiment, the sensory material is provided as flavoring for causing an olfactory sensory response in a human. A flavor is commonly understood to include a mixture of compounds that are volatile and produce an aromatic effect and that stimulate the olfactory bulb. Flavors are generally transmitted through the nasal passages, and are often selected and used for their unique association with certain consumer benefits, such as lavender for stress relief or relaxation. Another flavor example is chamomile, which has a strong, aromatic smell and is often used medicinally against sore stomach and as a relaxant to help you fall asleep. Chamomile is also used as a mouthwash against oral mucositis (the swelling, irritation, and ulceration of the mucosal cells that line the digestive tract). In another embodiment, the releasable material includes both a sensate component and a flavor component.

In one embodiment, the sensory material 300 can be associated with any two-dimensional or three-dimensional shape to provide a symbolic or visual communicative representation of a flavoring taste or a trigeminal sensation to be experienced by user when using the toothbrush 100. In a two-dimensional construction, the releasable material can be provided as a decal having a coating with a flavoring or sensate substance for the desired biochemical sensory response. In a three-dimensional construction, the releasable material 400 (FIG. 6) is raised from the head 105 and may have an outer topography with physical variations in the contouring. Hence, toothbrush 100 enables convenient visuals cues for communicating flavoring and/or sensation features to the user.

Figure 2:
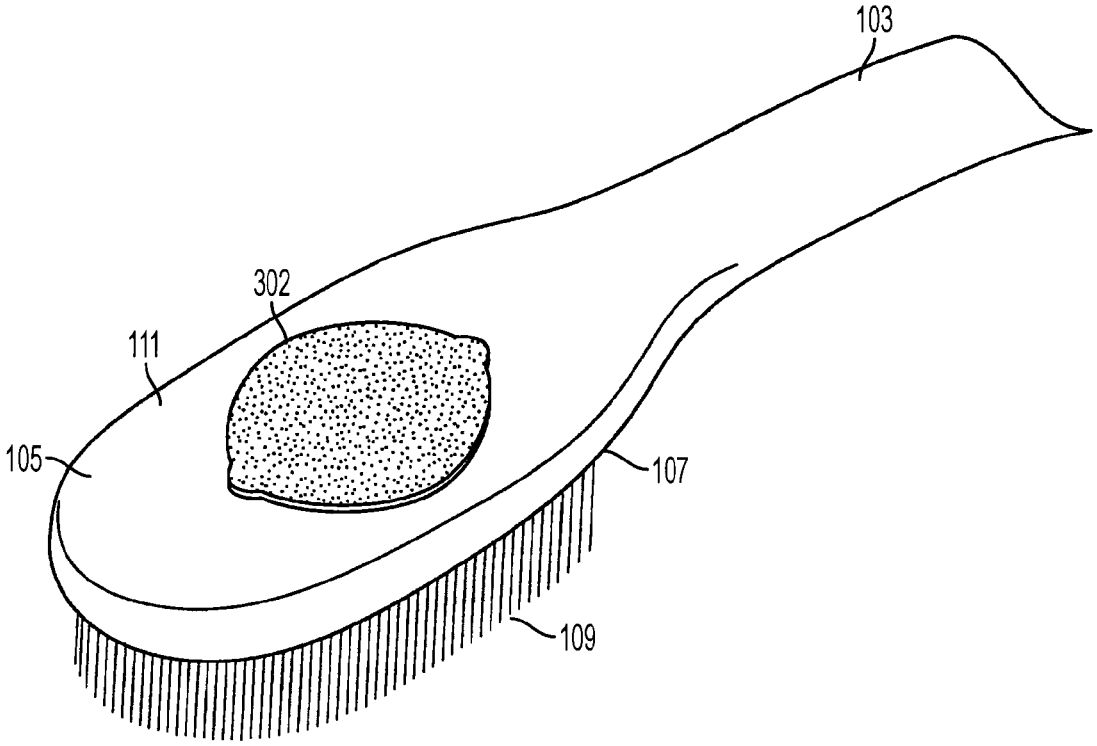

In the embodiment of FIG. 2, the sensory material 302 is provided as a lemon flavoring and disposed in a shape having a visual appearance and/or surface texture commonly known for a physical lemon. More generally, a toothbrush can have a fruit flavoring and the shape of the releasable material carrier can pertain to any fruit, such as an orange, strawberry, berry, grape, apple, mint, lemon, lime, etc. Of course, other flavorings and visual communicative elements can be used as desired. Hence, a user can selectively choose a toothbrush for a desired flavor by a particular visual feature.

Figure 3:
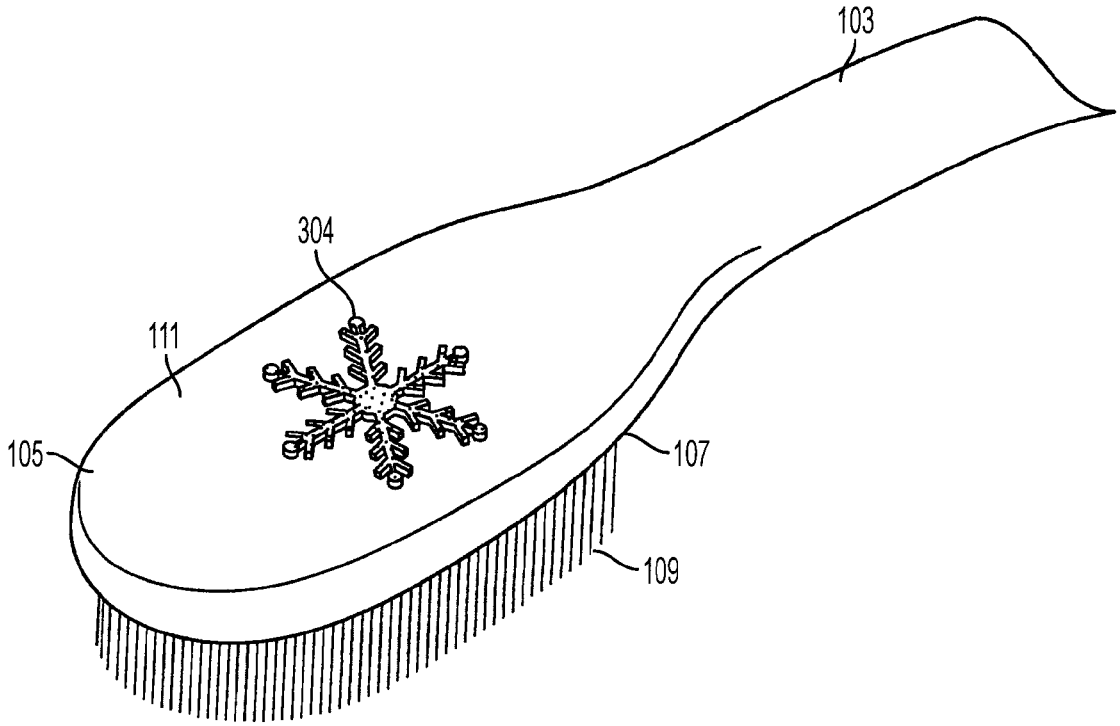
Figure 4:
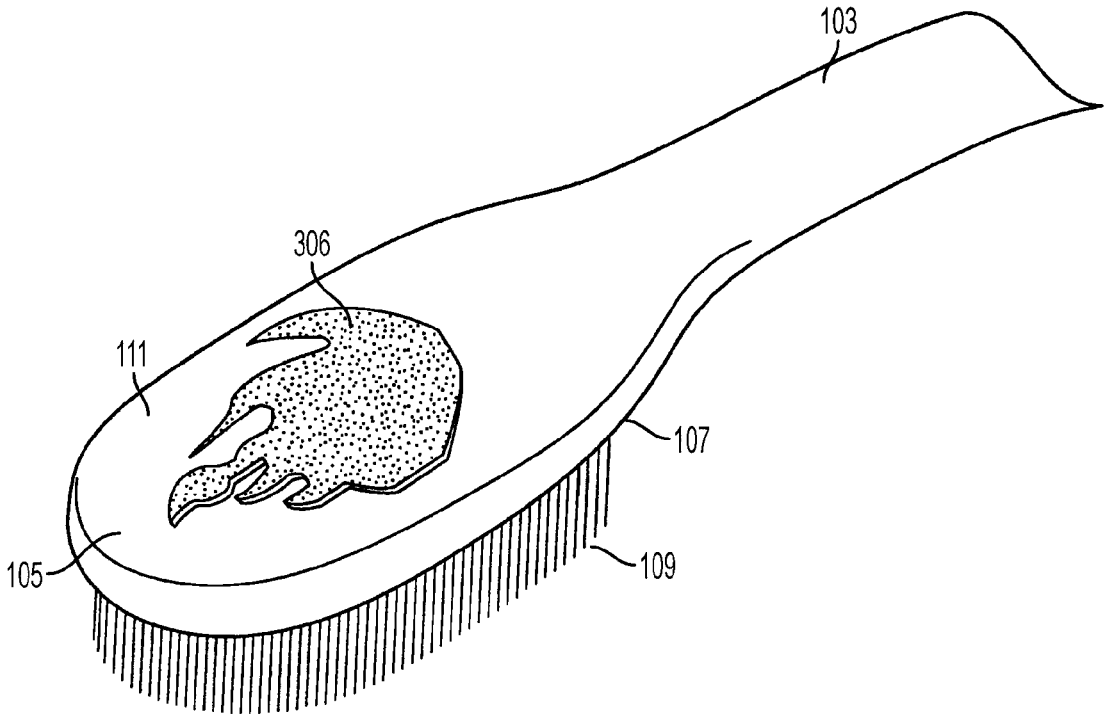

In another embodiment, a toothbrush is provided with a communicative element that suggests a cooling or heating sensation in a user. In FIG. 3, for example, a snowflake element 304 suggests the use of a sensate material that results in a cooling sensation or sensory response. Other non-limiting examples of communicative elements that suggest cooling sensations include visuals of ice, ice cubes, icebergs, icicles, polar bears, low temperature-reading thermometer, snow, snow-covered mountains, winter scenes, etc. In FIG. 4, communicative element 306 visually represented by a flame suggests a heating sensation. Other non-limiting examples of communicative elements that suggest heating sensations include visuals of a candle, gas flame, burning wood, burning coals, a desert, high temperature-reading thermometer, a stove, an oven, the sun, a flamethrower, etc. Similarly, a communicative element representative of a tingle sensation might appear as a vibration visual, a lightening bolt, pins and needles, etc. In this way, the user is provided with the ability to readily select a particular toothbrush or other oral care implement for the desired sensation by the supporting visual or communicative feature.

Figure 5:
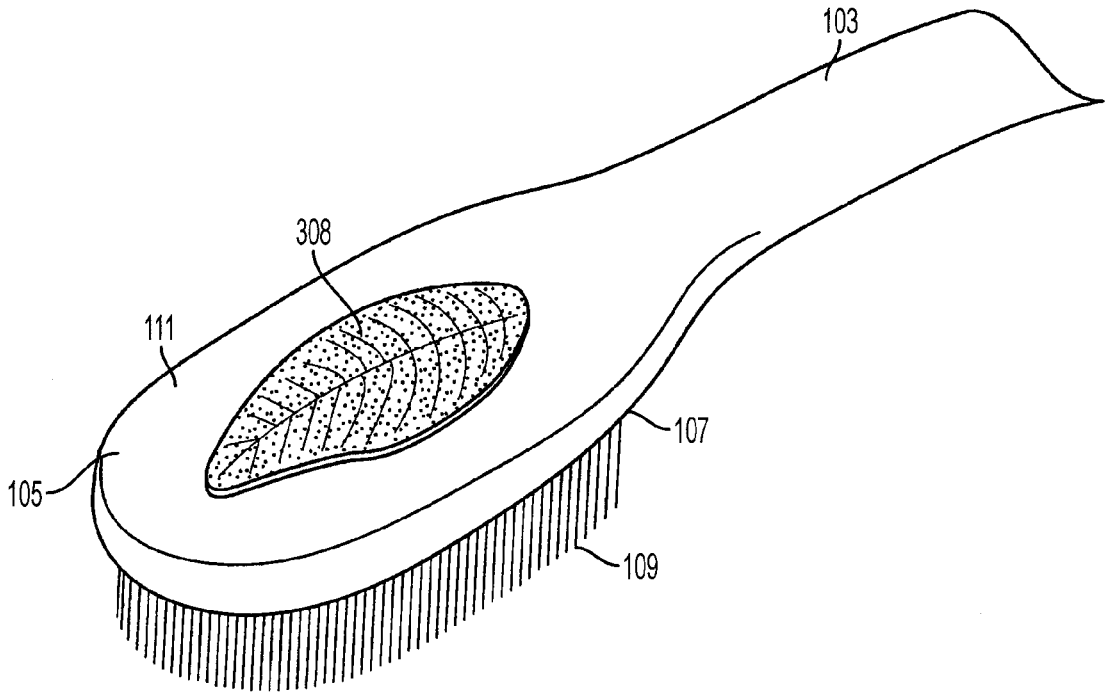

In one embodiment, FIG. 5 shows the sensory material 308 provided as a nutrient or herbal supplement, such as a vitamin or mineral, and in the shape of a leaf (e.g., *aloe vera* plant leaf). Such material could be combined with a soothing or sea breeze sensation to create a combined sensory and nutritive effect. Nevertheless, other shapes can be provided for the releasable material.

In other embodiments, the material 300 comprises a releasable active such as HUMPHRIES 3™ or benzocaine to be used for pain relief from teething or gum irritation in infants or children. Other homeopathic teething or inflammation soothing additive include, but are not limited to *Belladonna* (*atropa belladonna*), caffeine and *Passiflora Incarnata* (Passionflower). In another embodiment, zo-caine type of medicines can be used as an appetite suppressant for weight loss treatment. In yet another embodiment, the releasable material can be aspirin and the like. Further embodiments include materials used to clean or inhibit further accumulation of biofilm from/on shedding and nonshedding oral structures and/or tissues, or materials that have the ability to stimulate salvia flow thus relieving, temporarily, xerostoma or dry mouth. Thus, a wide variety of other chemicals which provide a medicinal or sensory response can be used with the oral care implement. In each case, associated visuals may be present communicate the beneficial effect, such as the representation of a throbbing tooth for benzocaine, a human figure with a slimming waist line for the zo-caine types of medicine or an "Rx" symbol for pain relief medication.

In one embodiment, the releasable material 300, 302, 304, 306, 308 is provided in a form of at least one solid dissolvable bead or a liquid encapsulated in a dissolvable or breakable outer cover (e.g., a container). Hence, the releasable material may be broken by the teeth of a user or dissolved by the salvia so as to release a liquid in the mouth.

In another embodiment, the releasable material 300, 302, 304, 306, 308 is provided in a biocompatible resilient material used in oral hygiene apparatus. Such a resilient material is preferably incorporated within an elastomeric material. In other embodiments, the elastomeric material can be molded in a desired shape for the symbolic representation of a flavoring or biochemical response from a sensate material. To provide comfort within the oral cavity, the elastomeric material preferably has a hardness property in the range of A8 to A25 Shore hardness. Non-limiting examples of elastomeric materials are styrene-butylene-styrene (SBS), styrene-ethylene/butylene-styrene block copolymer (SEGS), another material designated as G6725 manufactured by GLS Corporation, along with any direct or indirect food contact grade thermoplastic elastomer. In one construction, the resilient material can be incorporated within a polyolefin. Nevertheless, material from other manufacturers or other materials within and outside the noted hardness range could be used.

In one construction, the releasable material can be provided in a solution, emulsion or microencapsulation form, then deposited or applied to form a continuous or semi-continuous coating on the surface of the elastomeric material. The deposited solution, emulsion or microencapsulation may then be air-dried, heat assisted dried, heat assisted cured, catalyst assisted cured, or ultra-violet (UV) light activated cured. Nevertheless, other methods are possible for curing the coating.

In another construction, the releasable material can be integrally incorporated into an elastomeric material forming a part of the oral care implement, such that the sensate or flavoring or both can be released from within the elastomeric material. The releasable material may be compounded into an elastomer and/or thermoplastic. Alternatively, the releasable material may be embedded in microencapsulation form, and then compounded into the elastomer and/or thermoplastic. In this way, the releasable material can be released in a generally uniform manner during use of the oral care implement. In these arrangements, the elastomeric releasable material is provided as one homogeneous element. The releasable material migrates outward and transfers onto the mouth soft tissues upon contact. The releasable material can be pre-compounded or pre-formulated with hydrogel based, water-soluble polymers, or other biomaterial prior to final compounding into the elastomeric material or prior to final coating.

The releasable material provides a flavoring, taste or biochemical sensation or benefit during brushing, or preferably during multiple uses, or more preferably during three months of use. Hence, after daily use of the toothbrush for three months, the toothbrush can have a "use indicator" (e.g., a feature of communicating to the user that the sensory materials are "used up"). In this way, a user can visually distinguish a toothbrush with a desired flavoring and/or sensation and can have an enjoyable method of knowing when to obtain a new brush. For example, the flame 306 (FIG. 4) may start out as bright red, then gradually lose intensity (or turn black for example) as the sensory material is depleted.

Figure 6:
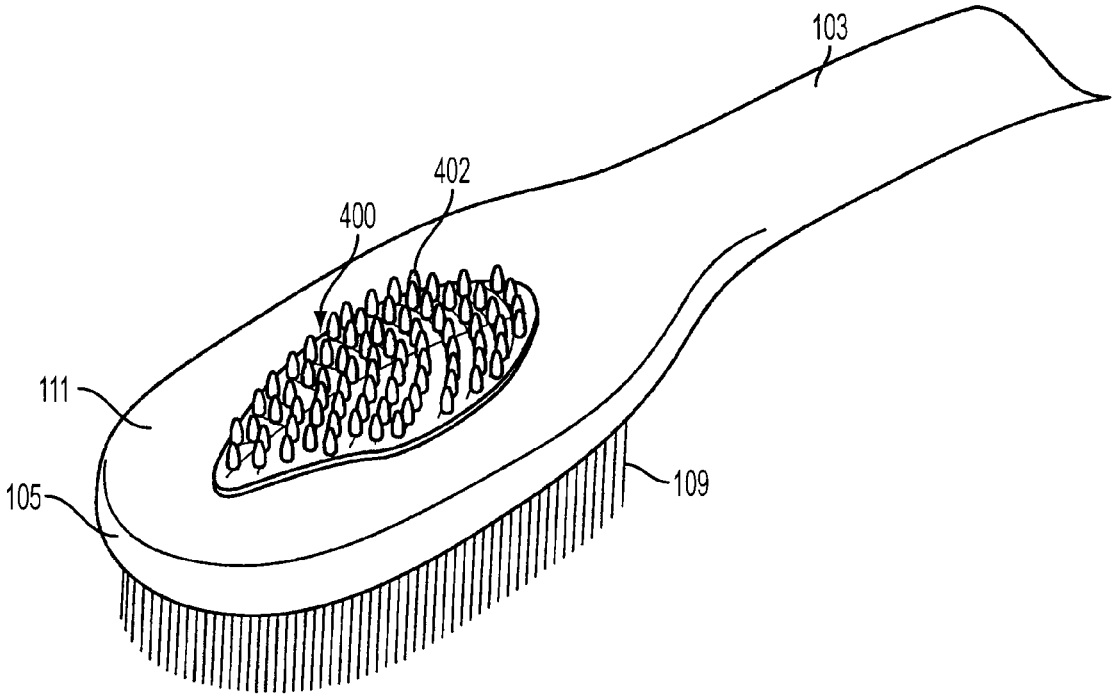

In one embodiment shown in FIG. 6, a tissue cleanser 400 is preferably composed of a soft pliable elastomeric material for comfortable cleaning and effective removal of bacteria and debris disposed on tissue in the mouth, such as the tongue, inner surfaces of the cheeks, gums, and lips. Tissue cleanser 400 includes at least one tissue engaging element 402 for cleansing oral tissue. Tissue cleanser 400 in an elastomeric construction can be incorporated with the releasable material as discussed in the previous embodiments. In the embodiment shown, tissue cleanser 400 is provided in a shape of the leaf for visually denoting a nutrient value and cleaning effects. Alternatively, the leaf could be in the shape of a mint leaf for visually denoting a mint flavor or sensation.

Figure 7:
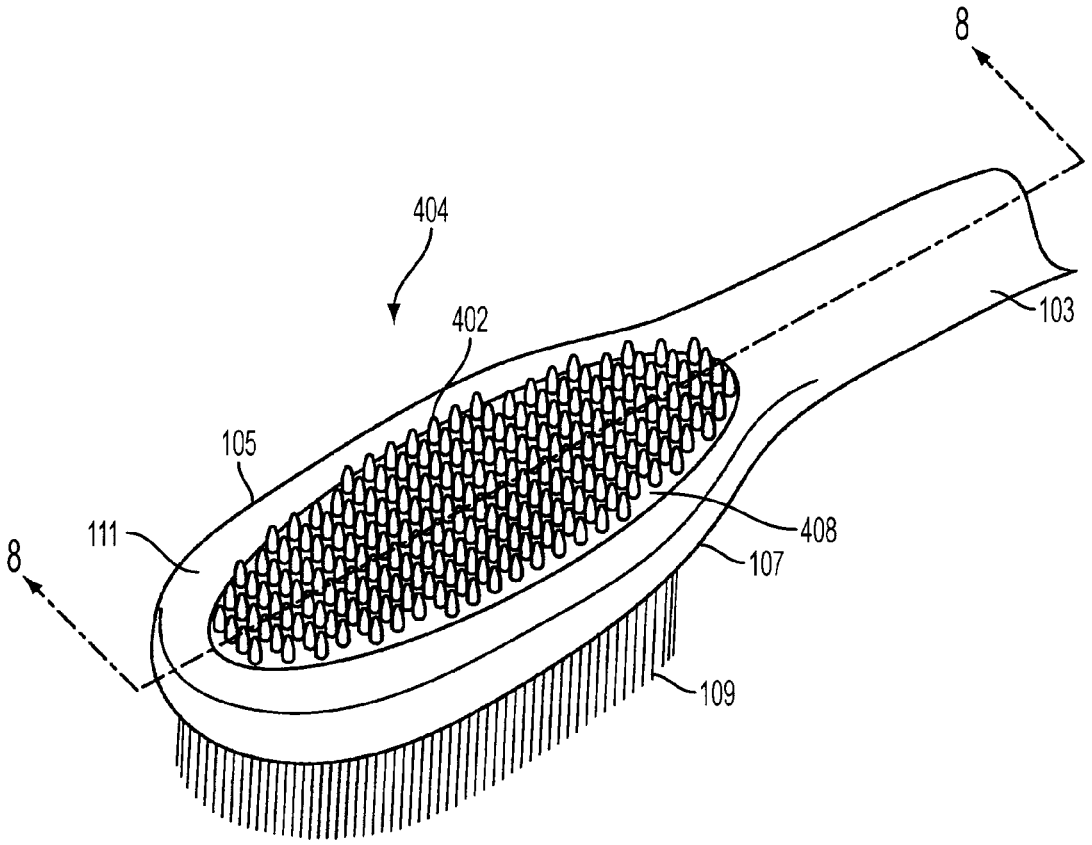
Figure 8:
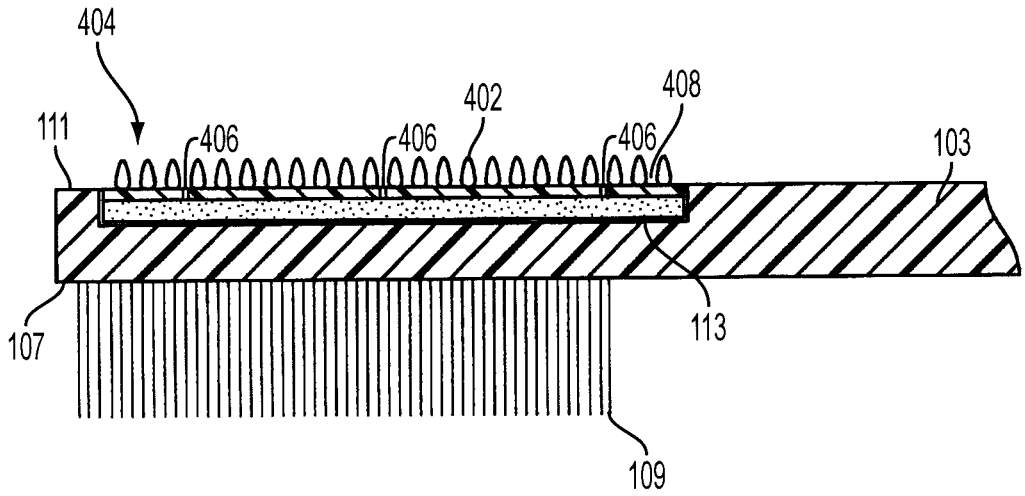
FIG. 8 is a cross section view along line 8-8 in FIG. 7.

In FIGS. 7-8, the releasable material 300 is provided in a basin 113 underneath a tissue cleanser 404. Pathways or openings 406 are provided in the elastomer surface 408 to enable a fluid, such as salvia, to dissolve the releasable material enabling the chemical in solution to migrate into the mouth of a user. As an alternative, the releasable material may be a fluid or gel that is encapsulated by the tissue cleanser 402 so that compression of the elastomer surface 408 squeezes the fluid through the openings 406 and into the mouth of a user. In either construction, cleaning of the tissue surfaces in the mouth may be obtained though the combined use of the tissue cleanser 404 mechanically scrubbing the tissue surfaces and the beneficial effects of applying flavoring or sensates around the oral cavity.

Tissue cleanser 400, 404 is preferably configured with a multiplicity of tissue engaging elements 402, which in the preferred construction are formed as nubs, and which will be described hereinafter for purposes of simplicity as "nubs." As used herein a "nub" is generally meant to include a column-like protrusion (without limitation to the cross-sectional shape of the protrusion) which is upstanding from a base surface. In a general sense, the nub, in the preferred construction, has a height that is greater than the width at the base of the nub (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height.

When engaged or otherwise rubbed against a tongue surface, for example, nubs 402 provide for gentle engagement with the soft tissue. Moreover, the nubs 402 are preferably soft so as to flex as needed to traverse and clean the tissue surfaces in the mouth. In the preferred construction, nubs 402 are able to flex and bend from their respective vertical axes as lateral pressure is applied during use. This flexing enhances the comfort and cleaning of the soft tissue surfaces.

In the embodiment of FIGS. 7-8, a first releasable material could be incorporated in the basin, while a second releasable material could be incorporated into the material forming the nubs (as discussed in FIG. 6), to create a combined sensorial effect. For example, the first releasable material could include a flavor, while the second releasable material could include a sensate, or vice versa, to create an enhanced flavor-based sensate that produces, for example, a cooling vanilla experience, or a hot cinnamon experience.

Such a combined experience could likewise be employed on other embodiments described herein, as the releasable material could vary in location and character across the oral care implement. For example, an oral care implement could have a combined visual of a snowflake (FIG. 3) within a lemon (FIG. 2), or a snowflake next to a lemon, that represents or visually communicates a cooling lemon-like sensation. Similarly, an oral care implement could have a mint leaf (FIG. 6) combined with a snowflake (FIG. 3) to represent a cooling mint sensation. Other sensory variations and combinations are contemplated.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. For example, while the visual communicative element is generally directly associated with the sensory response of the releasable material, such element may be indirectly associated, yet communicative of a particular experience. For example, visual depictions of human anatomical structures, such as a tongue, hand, ear, head, or gender based characterization, could be used to represent sensory materials targeting such structures, wherein an earache-curing material might be communicated by a visual representation of an ear. Similarly, a floral material might be communicated by a representation of a female figure, while a musk scent might be communicated by a representation of a male figure. Other indirect visual communicative elements include sporting equipment, such as a baseball, basketball, soccer ball, hockey puck, baseball bat, tennis racket, hockey stick, etc., which might represent sensory or active materials designed for sporting activities, such as, for example, energy boosting materials, vitamins, minerals and the like.

In addition, while the releasable material is preferably disposed on or incorporated within a portion of the oral care implement intended for insertion into the oral cavity, the visual communicative element could be associated with a component that is not so intended for insertion, such as a handle or the like. For example, instead of (or in addition to) the releasable material 302 in FIG. 2 being in the shape of a lemon, the handle 103 might be in the shape of a lemon, or have a lemon-based communicative element, to visually communicate the sensory effect of the releasable material 302. Thus, the communicative element might be physically separated from the releasable material, yet function to communicate the sensory effect to the consumer.

What is claimed is:

1. A toothbrush comprising:

a handle and a head;

a releasable sensory material that invokes a sensory response in an oral cavity during use; and at least one communicative element having a shape that is visually representative of the sensory response.

2. The toothbrush according to claim 1, wherein the releasable sensory material comprises a sensate.

3. The toothbrush according to claim 1, wherein the releasable sensory material comprises a flavor.

4. The toothbrush according to claim 1, wherein the releasable sensory material is contained in an elastomer.

5. The toothbrush according to claim 4, wherein the releasable sensory material is embedded in the elastomer.

6. The toothbrush according to claim 1, further comprising a surface coating of the releasable sensory material.

7. The toothbrush according to claim 1, wherein the releasable sensory material comprises caffeine.

* * * * *